United States Patent [19]

Ibuchi

[11] Patent Number: 4,664,503

[45] Date of Patent: May 12, 1987

[54] COPYING MACHINE

[75] Inventor: Yoshiaki Ibuchi, Nara, Japan

[73] Assignee: Sharp Kabushiki Kaisha, Osaka, Japan

[21] Appl. No.: 832,400

[22] Filed: Feb. 24, 1986

[30] Foreign Application Priority Data

Feb. 25, 1985 [JP] Japan ..... 60-37176

[51] Int. Cl.[4] ..... G03G 15/00

[52] U.S. Cl. ..... 355/14 SH; 355/3 SH

[58] Field of Search ..... 355/14 SH, 3 SH, 14 C, 355/14 R

[56] References Cited

U.S. PATENT DOCUMENTS 4,417,806 11/1983 Tani et al. ..... 355/14 SH 4,472,049 9/1984 Honma et al. ..... 355/14 SH

*Primary Examiner*—R. L. Moses

*Attorney, Agent, or Firm*—Birch, Stewart, Kolasch & Birch

[57] ABSTRACT

Disclosed is a copying machine which is provided with a cassette-loading area for allowing the loading of copy paper cassettes into a plurality of loading positions, a device for selecting any of these cassette-loading positions, and a timing roller that controls the timing of the transfer of copy paper fed from a selected cassette. The copying machine embodied by the present invention features a circuit for storing the timing data corresponding to the respective copy paper cassette loading positions and a device for driving the timing roller.

3 Claims, 6 Drawing Figures

COPYING MACHINE

BACKGROUND OF THE INVENTION

The present invention relates to a copying machine such as an electrophotographic copying machine.

When operating any conventional copying machine capable of loading copy-paper cassettes into a plurality of loading compartments, the copying paper delivered from any of these cassettes temporarily stops at the position of the timing roller which is installed immediately before the photorecepter drum. Strictly speaking, the position where the copying paper completely stops slightly varies depending on the cassette's position. The copying paper delivered from the cassette comes into contact with the timing roller at different angles and loads. Therefore, the period of time it takes for the paper to arrive at the photoreceptive drum varies, thus causing each sheet of paper to reach the predetermined position of the photoreceptor drum at a different time. As a result, conventional copying machines often cause copy paper to deviate from the transference position according to the individual cassette-loaded position. In other words, if a specific cassette-loaded position slightly deviates within the allowance, the range of the entire deviation cannot be ignored taking the entire cassette-loaded positions into account. This eventually results in defective copying of the needed data such as more ineffective areas or failure in the image development. FIG. 6 is a typical representation of the deviation of the image transference positions taking place with conventional copying machine. As is clear from this, the deviation takes place with copy paper delivered from individual cassettes within 3 mm of the range. However, as a whole, a deviation of nearly 4 mm can be noted.

SUMMARY OF THE INVENTION

To eliminate the disadvantages inherent in conventional copying machines as described above, the present invention provides a useful copying machine capable of minimizing the deviation in the transference position.

According to the present invention, the preferred embodiment provides means for storing the timing data dealing with each loaded position of the copy paper cassette as well as means for driving the timing roller in response to the timing data.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
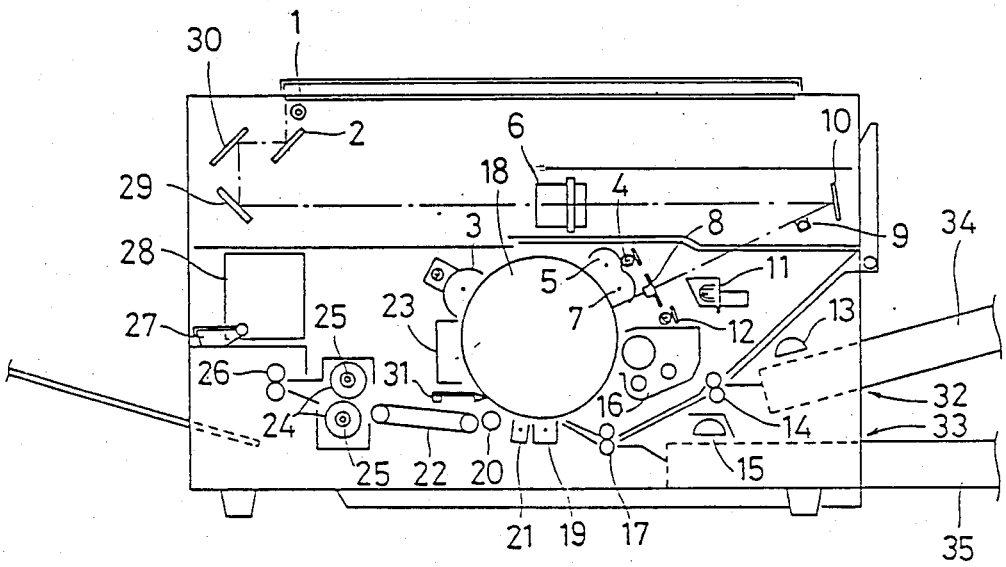
FIGS. 1 and 2 are sectional views showing the internal configuration of a copying machine according to the present invention.

FIG. 1 is a simplified sectional view of an electrophotographic copying machine incorporating an automatic paper-feeding device with upper and lower cassettes. The reference numeral 1 indicates a copying lamp, a first mirror 2, fifth charger 3 for discharging the AC current, a first lamp 4, a first charger, 6 a lens, 7 the second charger for discharging the AC current, a light-exposure slit 8, a light-exposure self-compensating shutter 9, a fourth mirror 10, a second lamp 11, a post lamp 12, an upper paper-feeding roller 13, a weight roller 14, a lower paper-feeding roller 15, a development unit 16, a timing roller 17, a photoreceptor drum 18, a third charger 19, a toner-stripping claw cleaning brush 20, a fourth charger 22 for discharging the AC current, 22 a suction unit 22, a cleaner unit 23, a toner-fixation roller 24, a heater lamp 25, a paper-delivery roller 26, a lock lever 27, a main motor 28, the third mirror 29, a second mirror 30, and a drum scraping claw 31. The reference numerals 32 and 33 respectively indicate upper cassette loading position and lower cassette loading position, which load copy paper cassettes 34 and 35, respectively.

Figure 2:
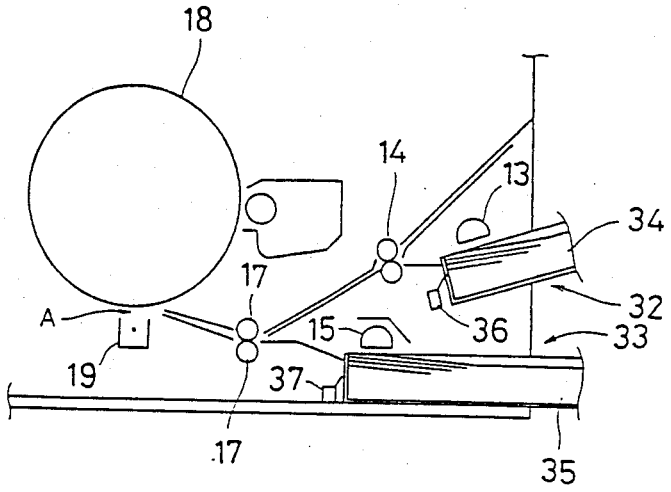

FIG. 2 is a schematic sectional view of the upper cassette loading position 32, the lower cassette loading position 33, the timing roller 17, and the transference position (arrowed A) of the photorecepter drum 18 of the entire mechanism shown in FIG. 1. As is clear from these drawings, the copy paper loaded in the lower cassette is fed by the lower paper-feeding roller 15 so that it comes into contact with the timing roller 17 in the horizontal direction. On the other hand, the copy paper loaded in the upper cassette is fed by the upper paper-feeding roller 13, which is then delivered to the timing roller 17 via the weight roller 14 before coming into contact with the timing roller 17. The reference numerals 36 and 37 respectively indicate switches for detecting whether or not both the upper and lower cassettes have been loaded in their designated positions.

Figure 3:
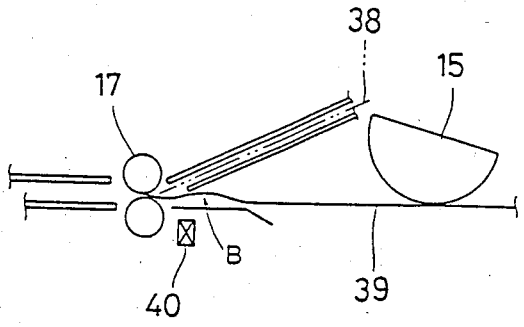
FIG. 3 is a schematic view showing the relationship between the timing roller and the copying paper in contact with it.

FIG. 3 denotes the state in which the copying paper comes into contact with the timing roller 17. The reference numerals 38 and 39 respectively indicate copying papers fed from the upper and lower cassettes. The copying paper 38 fed from the upper cassette comes into contact with the timing roller 17 by force of the rotation of the weight roller 14 and the weight of the copy paper itself. Conversely, the copy paper 39 fed from the lower cassette is sent forward by the lower paper-feeding roller 15. After coming into contact with the timing roller 17, this copying paper is again sent forward for a specific period of time so that a wave can eventually be formed as shown in the arrowed position B of FIG. 3. The loop is formed because the lower paper-feeding roller 15 can no longer send forward the copy paper and the copy paper 39 is delivered only by means of rotation of the timing roller 17. A detector switch 40 detects whether or not the copying paper 39 correctly comes into contact with the timing roller 17. As is clear from FIG. 3, the copy paper 38 comes into contact with the lower roller of the timing roller 17 whereas the copy paper 39 has a tendency to come into contact with the interim position between the upper and lower rollers of the timing roller 17 or with the upper roller of the timing roller 17. Even under such conditions the control system of the copying machine sets the timing for activating the timing roller 17 so that the copy paper 39 can be forwarded to the transfer position (A in FIG. 2) at a specific time after being delivered from the timing roller 17.

Figure 4:
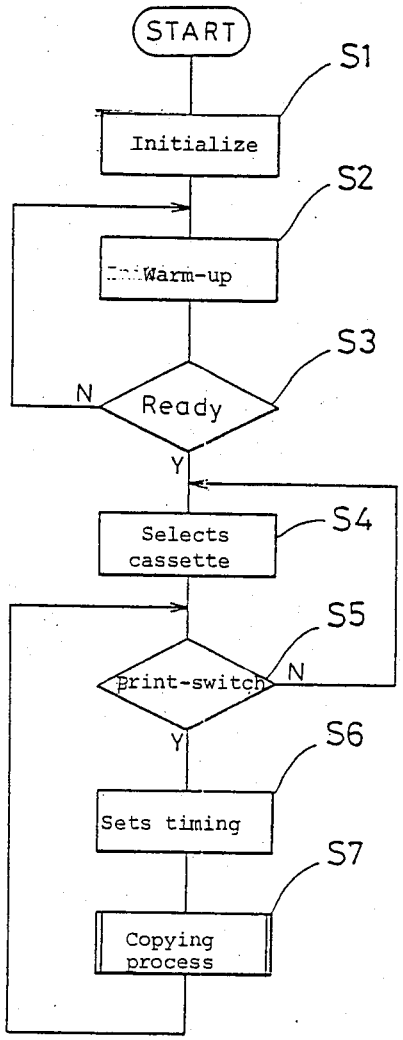
FIG. 4 is the operation flowchart describing the operation procedure for a copying machine related to the present invention.

FIG. 4 is an operation flowchart describing the operation procedure for the copying machine related to the present invention. First, when the power is on, step 1 is entered, and the status of all the controller units and the contents of the memory are initialized. When the mode enters step 2, the heat roller is warmed up in step 3, and the controller identifies whether the warming-up operation is completed or not. If the warming-up operation is completed, the operator selects the cassette containing the designated copy paper by loading the required cassette or by pressing the cassette-select button. The loaded position of the selected cassette is stored in a specific area of the memory.

Figure 5:
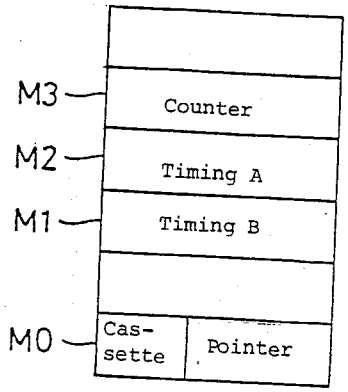
FIG. 5 is a table denoting the contents of the memory.
Figure 6:
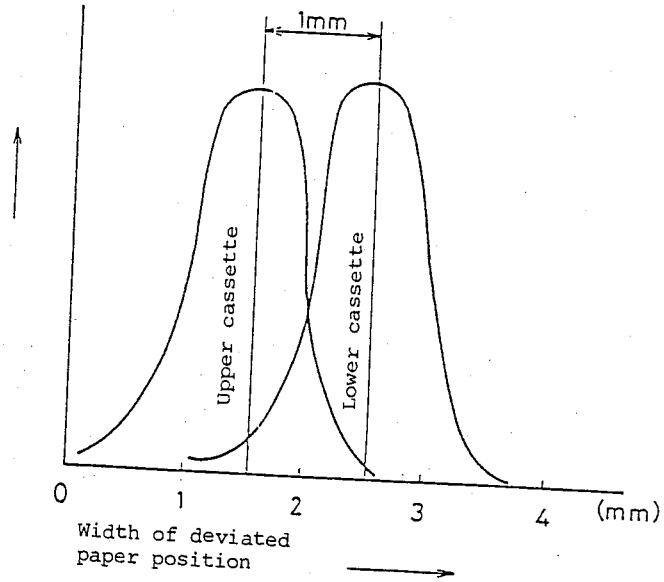
FIG. 6 is a graph of the uneven deviations in transference positions taking place within conventional copying machines.

FIG. 5 denotes the contents of the memory. Data related to the selection of the cassette-loaded position is stored in position M0-cassette of the memory shown in FIG. 5. If the print switch is pressed in this condition, the controller identifies this during step S5 as shown in FIG. 4 and then sets the required timing during step S6. Timing setting is executed by causing the value of the memory M0-pointer, shown in FIG. 5, to be designated by either memory M1 or M2. Memory area M1 stores the timing data when the copying paper is delivered from the lower cassette loaded position, whereas memory area M2 stores the timing data when the copying paper is delivered from the upper cassette loaded position. When step S7 in FIG. 4 is activated, the controller causes optical units including the copying lamp and mirrors to shift. After a specific period of time, following departure of these units from their home positions, the timing roller 17 is rotated. Counting of this specific period of time is executed in accordance with the timing data mentioned above. The specific period of time is counted in accordance with the contents of the memory (either timing A or timing B) as designated by the M0-pointer shown in FIG. 5.

In other words, after transferring the designated timing data to the counter of memory 3 as shown in FIG. 5, the contents of memory 3 are periodically increased, while the incremental content is identified by checking to see if it actually overflows. When the incremental content overflows, the controller rotates the timing roller. As is clear from the foregoing description, a copying machine incorporating the preferred embodiments of the present invention minimizes deviation of the image transference position to the copy paper by designating the cassette-loaded position and accordingly setting the optimum timing for the timing roller. Note that said timing data can also be adjusted independently after completing assembly of the copying machine. Even if the copy paper delivered from the selected cassette comes in contact with the timing roller at a different angle, since the tip positions of the copying papers eventually remain in accord with the latent image on the photoreceptor drum, the copying machine incorporating the preferred embodiments of the present invention eliminates any deviation in the image transfer position that might be caused by different paper cassette positions.

While only certain embodiments of the present invention have been described, it will be apparent to those skilled in the art that various changes and modifications may be made therein without departing from the spirit and scope of the present invention as claimed.

What is claimed is:

1. A copying machine having a cassette-loading area for loading a plurality of copy paper cassettes, means for selecting any of these cassette-loading positions, and a timing roller that controls the timing of transfer of the copy paper fed from a selected cassette in the loaded position, said copying machine comprising:

means for storing the timing data corresponding to said respective copy paper cassette loading position; and means for driving said timing roller according to said timing data.

2. The copying machine defined in claim 1, wherein said means for storing timing data is counted within a predetermined period before it overflows.

3. The copying machine defined in claim 2, wherein said timing roller is set to rotate simultaneously with the overflow of said means for storing timing data.

* * * * *